US007757515B1

(12) United States Patent
Starbuck

(10) Patent No.: US 7,757,515 B1
(45) Date of Patent: Jul. 20, 2010

(54) CUT PILE FABRIC AND METHOD OF MAKING SAME

(75) Inventor: Michael Starbuck, Earl Shilton (GB)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 12/402,187

(22) Filed: Mar. 11, 2009

(51) Int. Cl.
*D04B 9/12* (2006.01)

(52) U.S. Cl. ..... 66/92

(58) Field of Classification Search ..... 66/90, 66/107, 8, 9 R, 91, 92, 93, 194
See application file for complete search history.

(56) References Cited

U.S. PATENT DOCUMENTS

| | | | | | |
|---|---|---|---|---|---|
| 2,188,125 | A | | 1/1940 | Wigley | |
| 2,335,075 | A | * | 11/1943 | Needham | 66/8 |
| 2,364,649 | A | | 12/1944 | Palliser | |
| 3,041,859 | A | * | 7/1962 | Lie et al. | 66/92 |
| 3,241,337 | A | * | 3/1966 | Brooks, Jr. | 66/93 |
| 3,765,193 | A | * | 10/1973 | Conroux et al. | 66/9 R |
| 3,940,917 | A | | 3/1976 | Strachan | |
| 4,026,126 | A | * | 5/1977 | Nuber | 66/9 R |
| 4,127,013 | A | * | 11/1978 | Nuber | 66/92 |
| 4,409,800 | A | * | 10/1983 | Gutschmit et al. | 66/9 R |
| 4,537,048 | A | * | 8/1985 | Gutschmit et al. | 66/93 |
| 4,592,212 | A | * | 6/1986 | Schmidt | 66/91 |
| 5,025,644 | A | | 6/1991 | Nielsen et al. | |
| 5,090,218 | A | | 2/1992 | Schuler et al. | |
| 5,186,025 | A | * | 2/1993 | Neher | 66/9 R |
| 5,205,140 | A | | 4/1993 | Nielsen et al. | |
| 5,239,844 | A | | 8/1993 | Sos | |
| 5,463,882 | A | * | 11/1995 | Yeh | 66/92 |
| 5,862,681 | A | * | 1/1999 | Schmidt | 66/9 R |
| 5,916,273 | A | | 6/1999 | Hepfinger | |
| 6,094,944 | A | * | 8/2000 | Schmidt | 66/92 |
| 6,128,930 | A | * | 10/2000 | Schmidt | 66/92 |
| 6,242,370 | B1 | | 6/2001 | Dischler | |
| 6,298,692 | B1 | | 10/2001 | Kuroda et al. | |
| 7,552,602 | B2 | * | 6/2009 | Knight et al. | 66/9 R |

* cited by examiner

*Primary Examiner*—Danny Worrell
(74) *Attorney, Agent, or Firm*—Womble Carlyle Sandridge & Rice PLLC

(57) ABSTRACT

A knit fabric may be formed by providing a plurality of cylinder needles and a plurality of cutting needles having a cutting surface. A first yarn may be fed to the plurality of cylinder and the plurality of cutting needles to form loops during a knitting cycle. A second yarn may be fed to the plurality of cylinder needles during the knitting cycle so that the first yarn and the second yarn having a plated relationship on the plurality of cylinder needles. A pile may be formed on the knit fabric by cutting the loops on the cutting needles with the cutting surface.

15 Claims, 10 Drawing Sheets

CUT PILE FABRIC AND METHOD OF MAKING SAME

FIELD OF THE INVENTION

The present invention is related to knit fabrics having a pile, and particularly to a novel method of forming a cut pile on a fabric during knitting.

BACKGROUND OF THE INVENTION

Pile fabrics generally comprise a type of fabric that has loops, yarns, or fibers extending outwardly from a base fabric structure. Pile fabrics, and cut pile fabrics in particular, have several benefits over conventional textile materials. The pile height, the pile count, i.e., density of the pile, yarn, and fiber type forming the pile and fabric may be engineered to yield a range of end-use properties not available in conventional textile fabrics. For example, a pile fabric may have a rich surface appearance that is soft and plush. Improved adsorbency, (e.g. terry towels, specific cushioning and compression profiles, e.g., for tufted carpeting or hosiery), may also be engineered into the fabric by modifying one or more components of the pile fabrics. The advantages of design flexibility and unique properties that pile fabrics offer are balanced against the disadvantages of higher manufacturing costs and a more complex manufacturing system and supply chain.

The manufacture of many cut pile fabrics includes one or more cutting processes to form the desired pile height of a given fabric. These cutting steps are in addition to the dyeing and finishing steps common to many textile applications. Even modern cutting machines operating under the best conditions result in the loss of approximately 30% of the fabric weight.

There is a need, therefore, to form a cut pile during knitting, and in particular, a need to form a cut pile while forming a weft knit fabric so that a wide variety of yarns and fibers may be used to form the cut pile fabrics while minimizing manufacturing cost and complexity.

DETAILED DESCRIPTION OF THE INVENTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

A cut pile fabric may be formed during knitting on a weft knitting machine using two types of knitting needles. The needle types may include conventional knitting needles and a second type of knitting needle that has a cutting surface, i.e., the cutting needles. The cutting needles may sever a yarn during knitting to form a cut pile. The knitting needles may receive at least two yarns from separate yarn sources, i.e., feeders. The two yarns may form plated loops during one or more stages, but not necessarily each stage of a knitting cycle. One of two yarns may be received by both types of knitting needles, while the other yarn may be received by the conventional needles. The cutting knitting needles may be held stationary during the final stages of a knitting cycle to form loops with the plated yarn pair to hold the cut pile in place.

Figure 1:
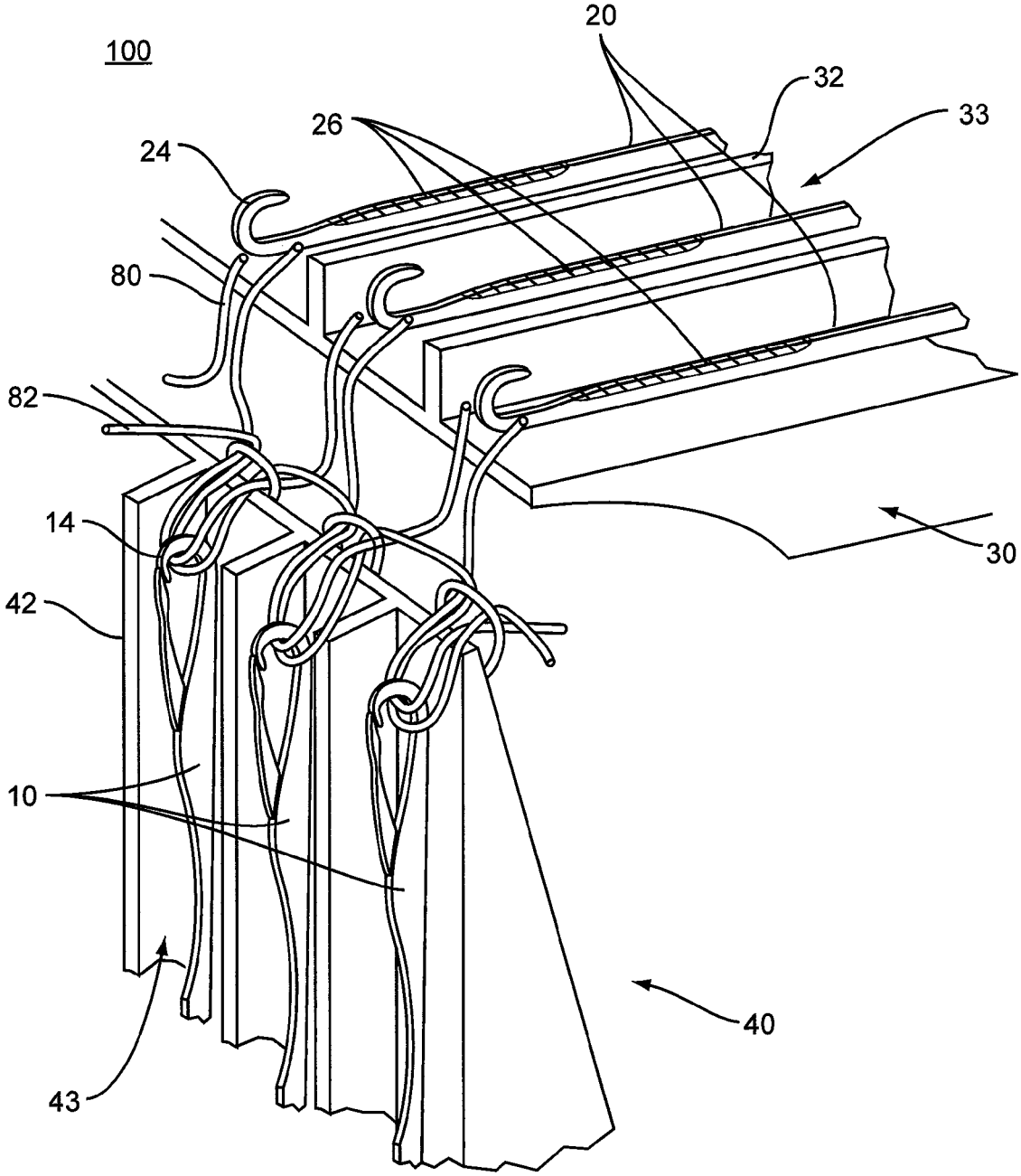
FIG. 1 shows a top perspective view of a segment of a knitting machine used to form a cut pile fabric according to the present invention.

FIG. 1 illustrates a knitting machine 100 used to form a cut pile fabric. The knitting machine 100 may be a conventional cylinder and dial machine. The cylinder 40 may have a trick wall 42 forming slots 43 with the cylinder needles 10, i.e, the conventional needles, housed therein. The dial 30 may also have trick walls 32 that form dial slots 33 housing cutting needles 20. The cutting needles 20, as shown herein, have cutting surfaces 26 that sever the yarns during knitting to form cut loop ends on the fabric surface. In alternate embodiments, a v-bed knitting machine may be used to form the cut pile fabric. A v-bed knitting machine may also use two types of two knitting needles similar to those used in a dial and cylinder machine described above.

Two types of knitting needles may be used to form a cut pile fabric, as illustrated in FIGS. 2A-3B. In alternative embodiments, a knitting machine 100 may use more than two types of knitting needles to form a cut pile fabric. Further, two or more types of knitting needles may be used on either dial 30 or cylinder 40 of the knitting machine 100. In other embodiments, each type of knitting needle, i.e., a conventional needle and a cutting needle, may be used on the same dial 30 of the knitting machine 100. When two types of knitting needles are used on the cylinder 40, (or the dial 30), a knit fabric having regions of cut piles and regions of a rib knit may be formed.

Figure 2B:
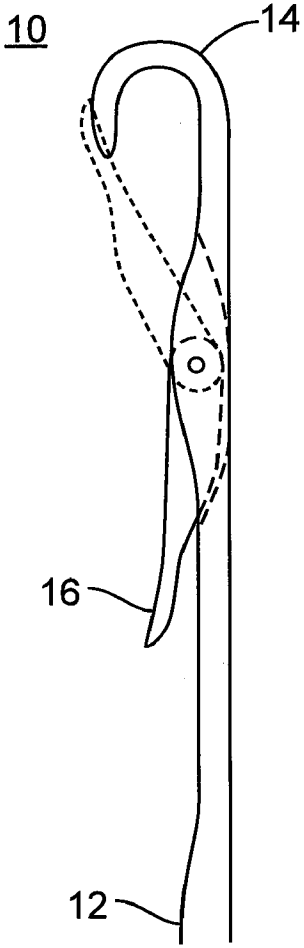
FIGS. 2A and 2B show side and detail views of a needle used to form a cut pile fabric.
Figure 2A:
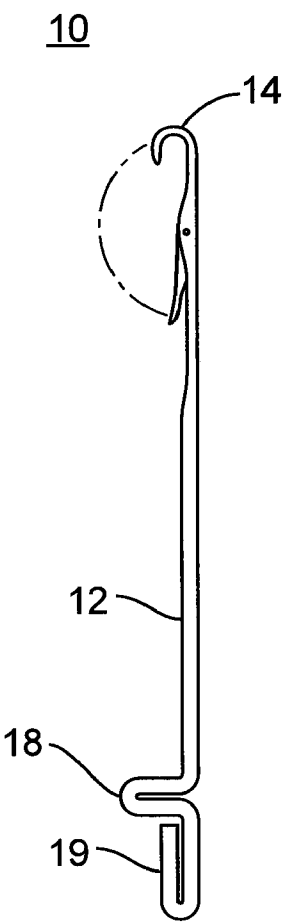

Cylinder needle 10 is shown in FIGS. 2A and 2B. The cylinder needle 10 has a hook 14 and latch 16 operably connected to the stem 12. The latch 16 pivots to open or close the hook 14, as shown in FIG. 2B. FIG. 2B illustrates the latch 16 in a closed position. In alternative embodiments, the latch 16 may be connected in any other manner known to pivot latch 16 to open and close the hook 14, such as hinging the latch 16 upon stem 12. The cylinder needle 10 may have a tail 19 and needle butt 18 located proximate to the end of the stem 12. The tail 19 and butt 18 may engage cams of a knitting machine (not shown). More particularly, needle butt 18 may engage a cam path which guides the movement of the cylinder needle 10 during a knitting cycle.

Figure 3B:
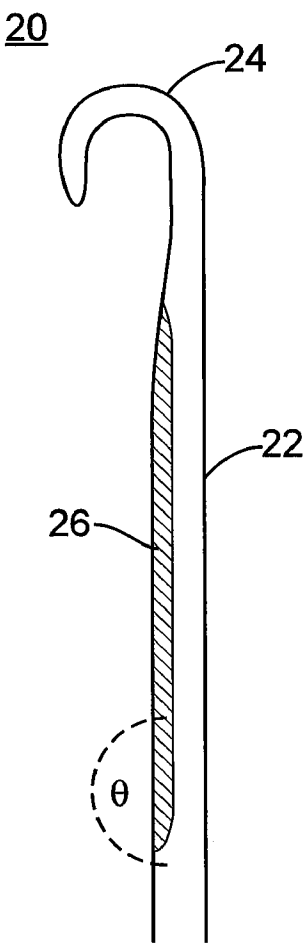
FIGS. 3A and 3B show side and detail views of a needle with a cutting surface used to form a cut pile fabric.
Figure 3A:
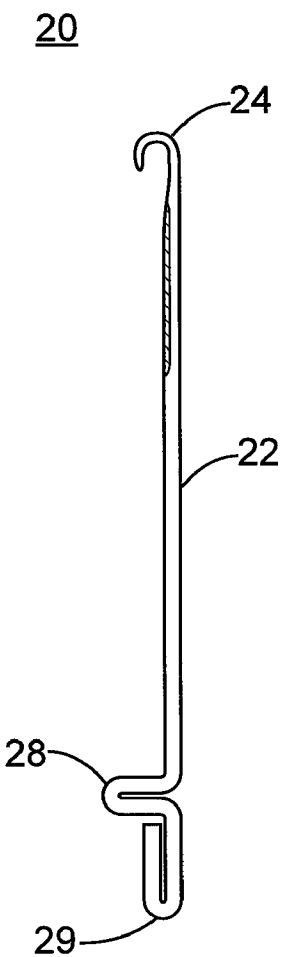

FIGS. 3A and 3B illustrate a cutting needle 20 used to form the cut pile fabric. The cutting needle forms and severs the loops during knitting. A hook 24 at one of the ends of a stem 22 receives a yarn. A cutting surface 26 severs a yarn or loop during knitting. The cutting surface 26 shown in FIG. 3A may be substantially parallel to the longitudinal axis of the stem 22. In other embodiments, however, the cutting surface 26 may have any profile along the stem 22. For example, the profile may be curvilinear, serrated, saw-tooth, notched, or a sine-cosine wave. A needle butt 28 and tail 29 located proximate to the end of the stem 22 cooperates with the dial cams and the cam path to move the cutting needle 20 during the knitting cycle.

Figure 4:
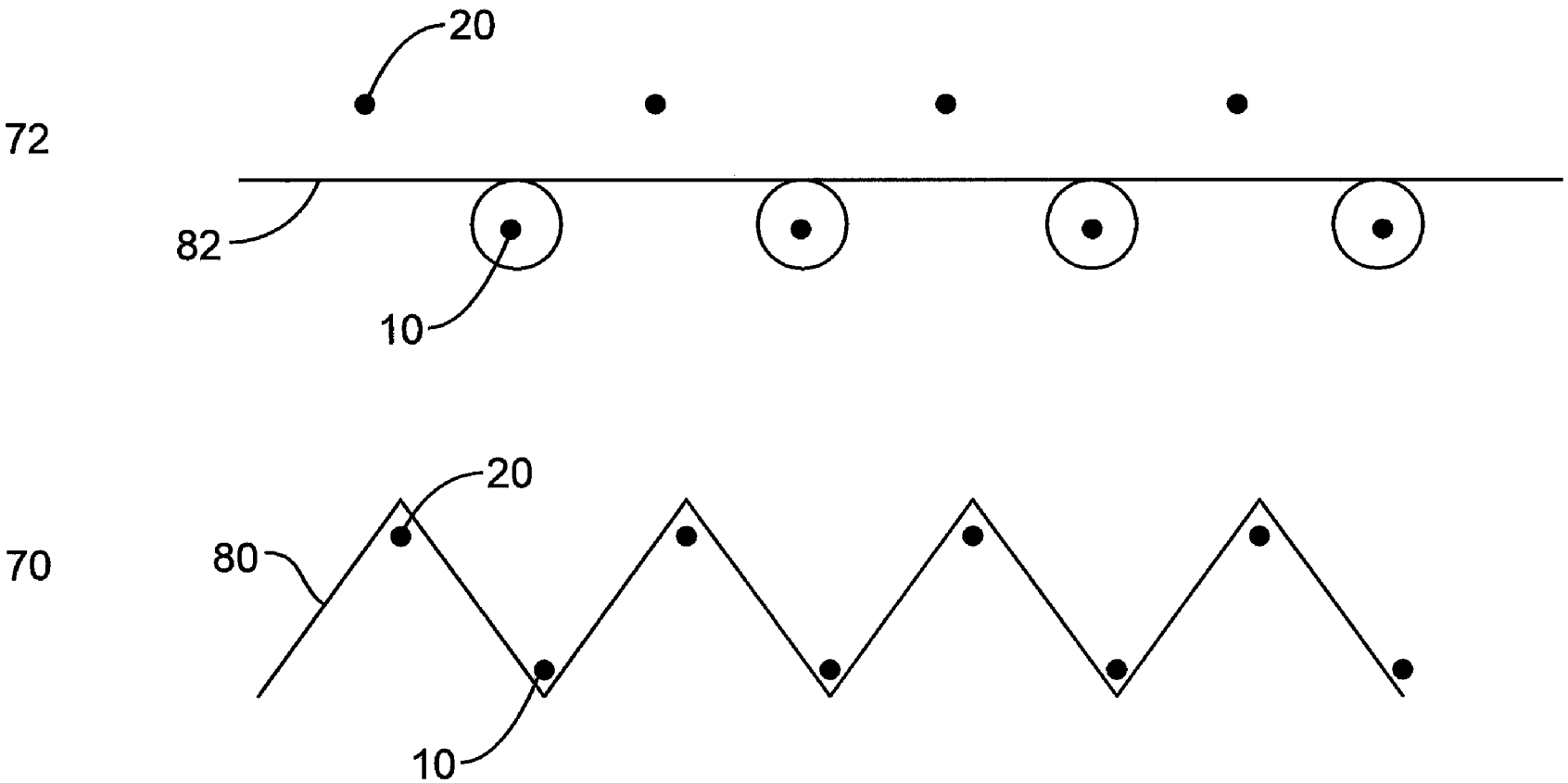
FIG. 4 is a knitting notation diagram for forming a cut pile fabric.

At least two yarns may be used to form the cut pile fabric. FIGS. 1 and 4 show a first yarn 80 and a second yarn 82. Each yarn may be introduced to the knitting needles separately and in a way that forms a plated yarn pair during the knitting cycle, but not necessarily at each stage of the knitting cycle. The first yarn 80 and the second yarn 82, or any additional yarn, may have independent and separate feeds so that yarn tension may be separately monitored and maintained. The separate yarn feeds supplying the yarns that form plated yarn pairs allow a wide range of yarn constructions, yarn types, and fiber types to be used to form cut pile fabrics.

Several different yarn types may be used to form the cut pile fabric described herein. The first and second yarns 80 and 82 may comprise staple yarns, continuous filament yarns, single plied yarns, multiple-plied yarns, or combinations thereof. Further, first and second yarns 80 and 82 may be open end, ring spun, air jet spun, rotor spun, core-spun, or continuous filament yarns. In alternative embodiments, one of the yarns may be one yarn type, while the other yarn may be a different yarn type. For example, the first yarn 80 may be a ring spun yarn and the second yarn 82 may be a continuous filament yarn.

The first yarn 80 and second yarn 82 may have a range of linear densities, or cotton count (cc). The linear density of the first yarn 80 and the second yarn 82 may be between about 4/1 cc and about 50/1 cc. In one embodiment, the linear density of the first yarn 80 may be larger than the linear density of the second yarn 82. For example, the first yarn 80 may have a cotton count of about 26/1 cc and the second yarn 82 may have a cotton count of about 8/1 cc. In alternate embodiments, however, the linear density of the first yarn 80 may be about the same as the linear density of the second yarn 82.

The cut pile fabric may also comprise yarns formed from natural or synthetic fibers. The fibers may be cotton, rayon, polyester, polypropylene, polyamide 6 or polyamide 6,6, wool, acrylic, or combinations thereof. In alternate embodiments, bi-component fibers may be used, such as sheath-core, side by side, tri-lobal tipped, or islands in the sea. The fibers may be used alone, or combined in an intimate blend.

FIG. 4 illustrates a knitting notation for a cut pile fabric. The first position 70 illustrates how a first yarn 80 may engage the cylinder needles 10 and the cutting needles 20. The second position 72 illustrates how the second yarn 82 forms loops around the cylinder needles 10 while not engaging the cutting needles 20.

FIGS. 5A-5D and 6 illustrate the formation of a cut pile fabric during the knitting cycle. The knitting cycle may have at least four stages that represent movement and position of both types of knitting needles during formation of a cut pile fabric. The knitting cycle includes a tuck height position 62, tuck/yarn feeding position 64, held stitch position 66, and knock over position 68. Needles pass through each stage during formation of a cut pile fabric receiving the first 80 and second 82 yarns and forming cut loops 94 that yield a cut pile. Movement of the needles in a first direction (34 or 44) and second direction (36 or 46) during the knitting cycle depends upon the position of needle butts (18 or 28) in cam paths 135 and 145 (shown in FIG. 6).

Figure 6:
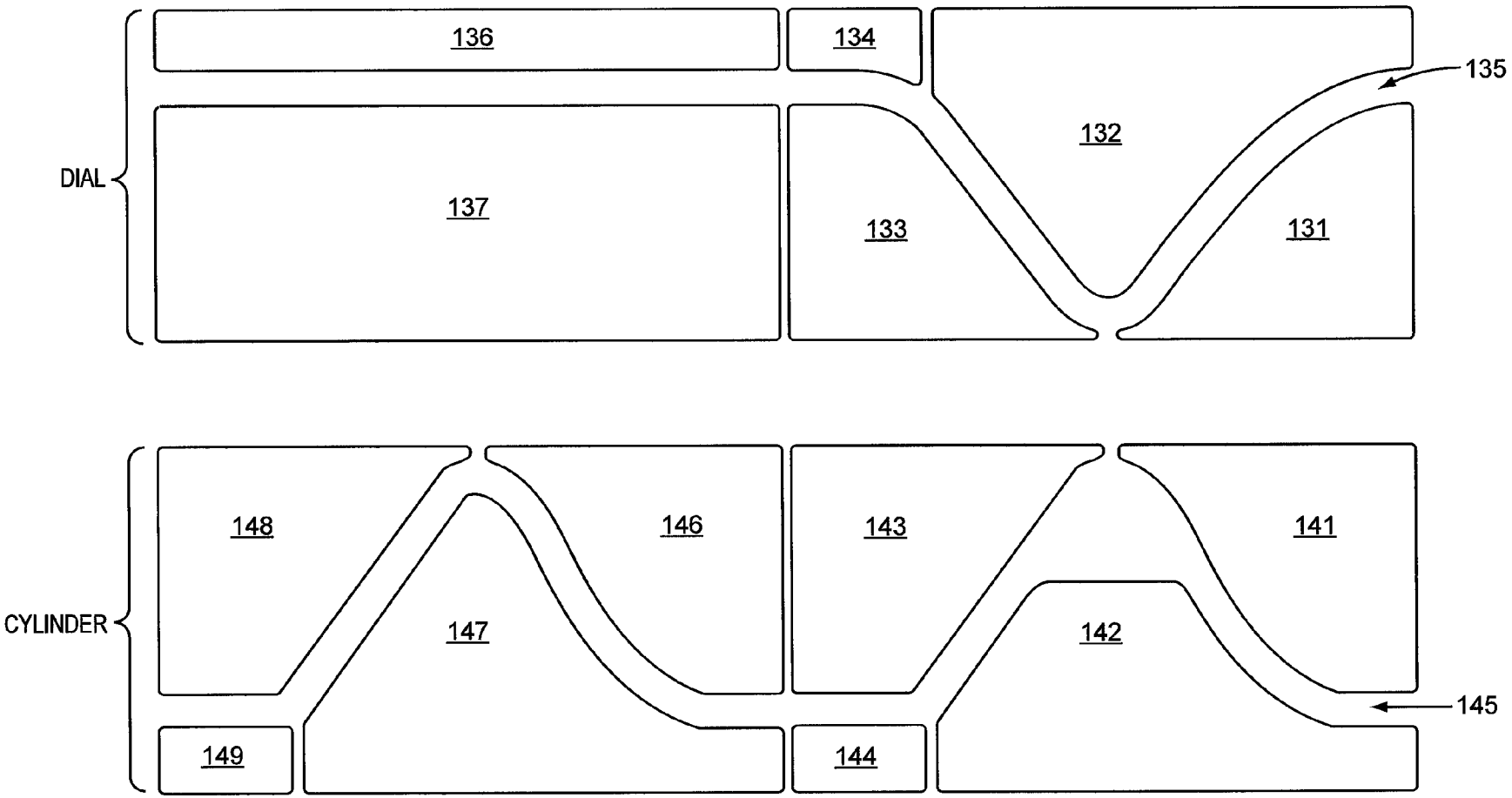
FIG. 6 shows a schematic of cams used in a knitting machine to form a cut pile fabric.

A schematic of the cylinder 145 and dial 135 cam paths are shown FIG. 6. The cylinder cam path 145 is formed by guard cams 141 and 146, tuck cam 142, stitch cams 143 and 148, and up throw cams 144, 148 and 149, and forms the path through which needle butt 18 (not shown) may travel during knitting. Movement of the cylinder needle 10 up, i.e., in a first direction 44, or down, i.e., in a second direction 46, in cylinder slot 43 depends upon the location of the needle butt 18 in the cylinder cam path 145.

The dial 30 has a cam path 135, as shown in FIG. 6. Movement of the cutting needle 20 in a first direction 34, i.e., towards the cylinder 40, and second direction 36, i.e., away from the cylinder, may also depend on the location of the needle butt 28 within the dial cam path (135 or 145). The dial 30 has guard cams 131 and 134, up throw cam 132, and stitch cam 133 as described above for the cylinder 40. In addition, two held stitch cams 136 and 137 form a straight, or linear, upper portion of cam path 135. Held stitch cams typically form held stitches when used in knitting machines. The dial cam path 135 at near at the held stitch cams 136 and 137 maintain the cutting needle 20 retracted within in the dial 30 at the held 66 and knock over 68 positions, as will be described below.

Figure 5A:
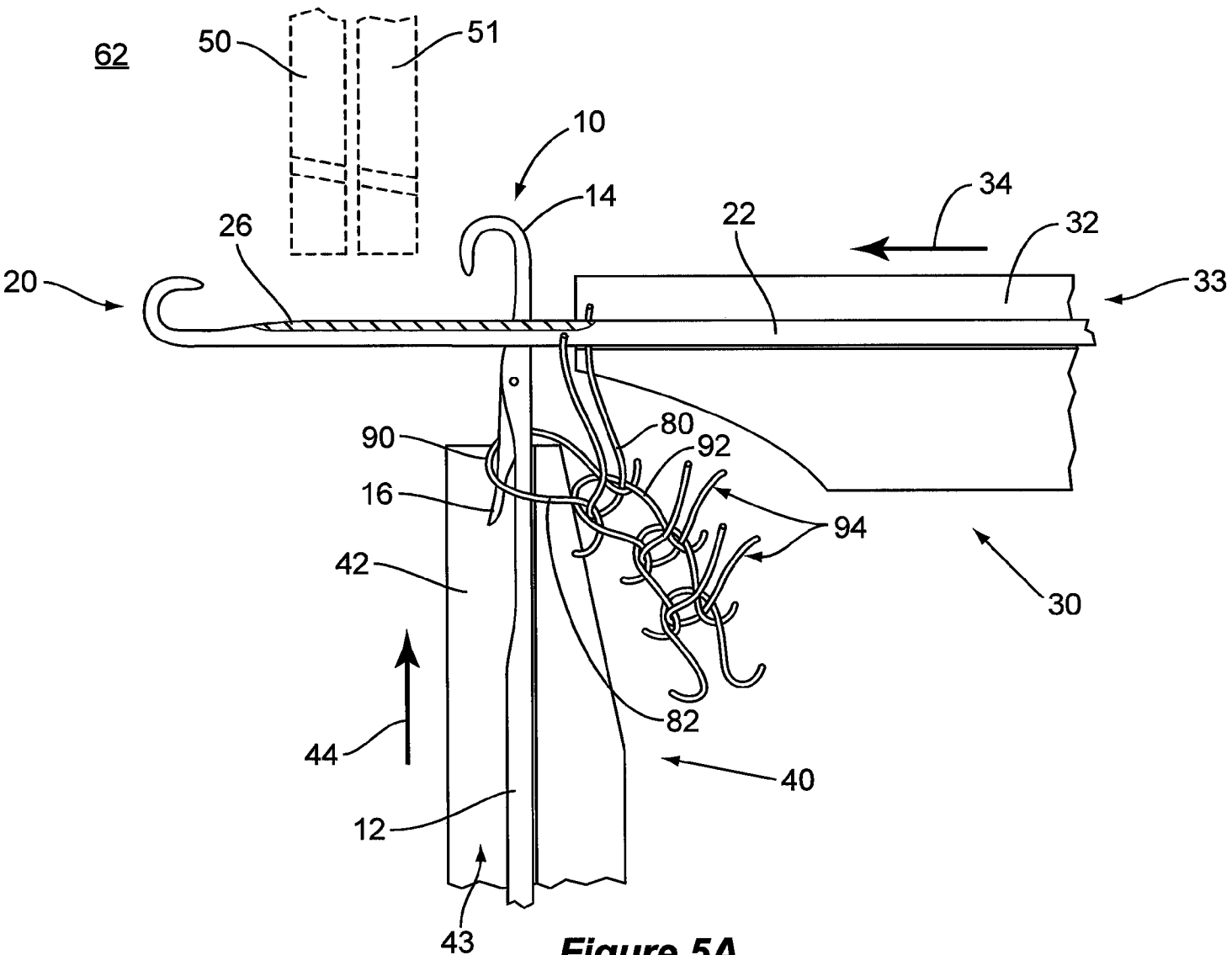
FIGS. 5A through 5D show side views of a portion of a knitting machine at different stages of a knitting cycle used to form a cut pile fabric.

The tuck height position 62 is shown in FIG. 5A. The tuck height position 62 corresponds to position 70 in the knitting notation shown in FIG. 4. The tuck height position generally corresponds to the position of the cylinder needle 10 between the tuck cam 142 and the first guard cam 141, while the cutting needle 20 is generally near the tip of the first up throw cam 132 in the dial 30, as shown in FIG. 6. The cutting needle 20 is shown generally As the cutting needle 20 moves in a first direction 34 across cylinder needle 10, the cutting surface 26 severs the first yarn 80 to form a cut loop 94. While severing the first yarn 80, the cutting needle 20 moves toward cylinder needle 10 and yarn feeders 50 and 51 to receive a new yarn (for illustration, the yarn feeders are shown in dashed lines).

As the first yarn 80 is being severed, the cylinder needle 10 rises in direction 44 towards the tuck height. The new loop 90 remains tucked around the cylinder needle 10 and on the open latch 16. The new loop 90 is formed at the end of the previous knitting cycle. The cylinder needle 10 may move towards tuck position 64 while maintaining the new loop 90 on the open latch 16. The previously formed loops 92 hold the cut loop 94 in position at base of the new loop 90.

Figure 5B:
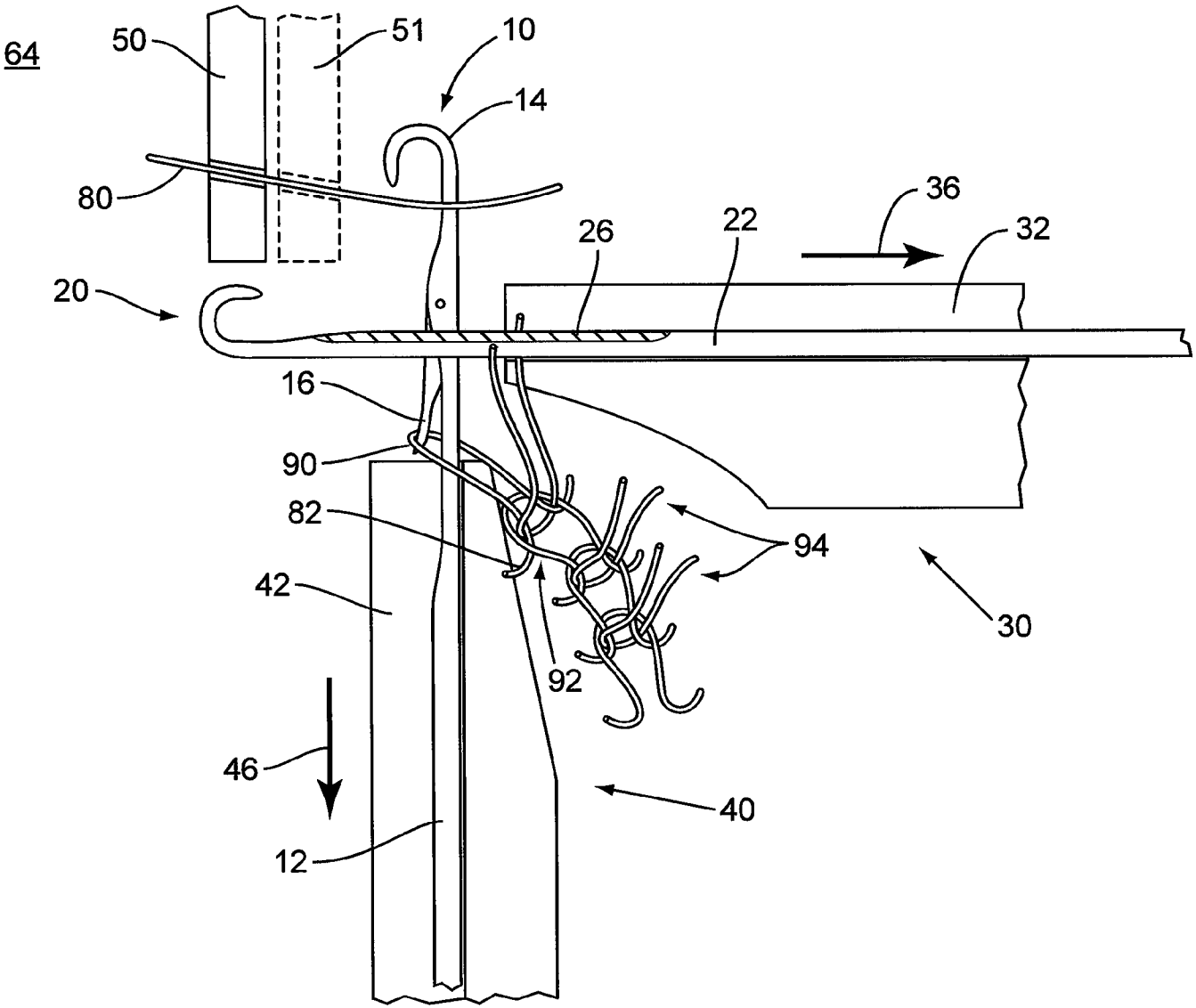

The tuck position 64 is shown in FIG. 5B. The cylinder needle 10 is shown at about its highest position above the cylinder 40, i.e., the needle butt 18 may be at the upper portion of tuck cam 142, as shown in FIG. 6. The hook 14 of the cylinder needle 10 receives the first yarn 80 from the first yarn feeder 50 (yarn feeder 51 is shown with dashed lines). From the tuck position 64, the cylinder needle 10 moves in a second direction 46 toward the held position 66, pulling the first yarn 80 within hook 14 toward the cutting needle 20. The cutting needle 20 is shown at about its outermost position across the cylinder needle 10 at tuck position 64, i.e. the needle butt 28 may be proximate the tip of the up-throw cam of 132 shown in FIG. 6. The cutting needle 20 may move in a second direction 36, receiving the first yarn 80 within its hook 24. FIG. 5B illustrates the cylinder needle 10 and the cutting needle 20 just prior to the held position 66, as shown in FIG. 5C.

Figure 5C:
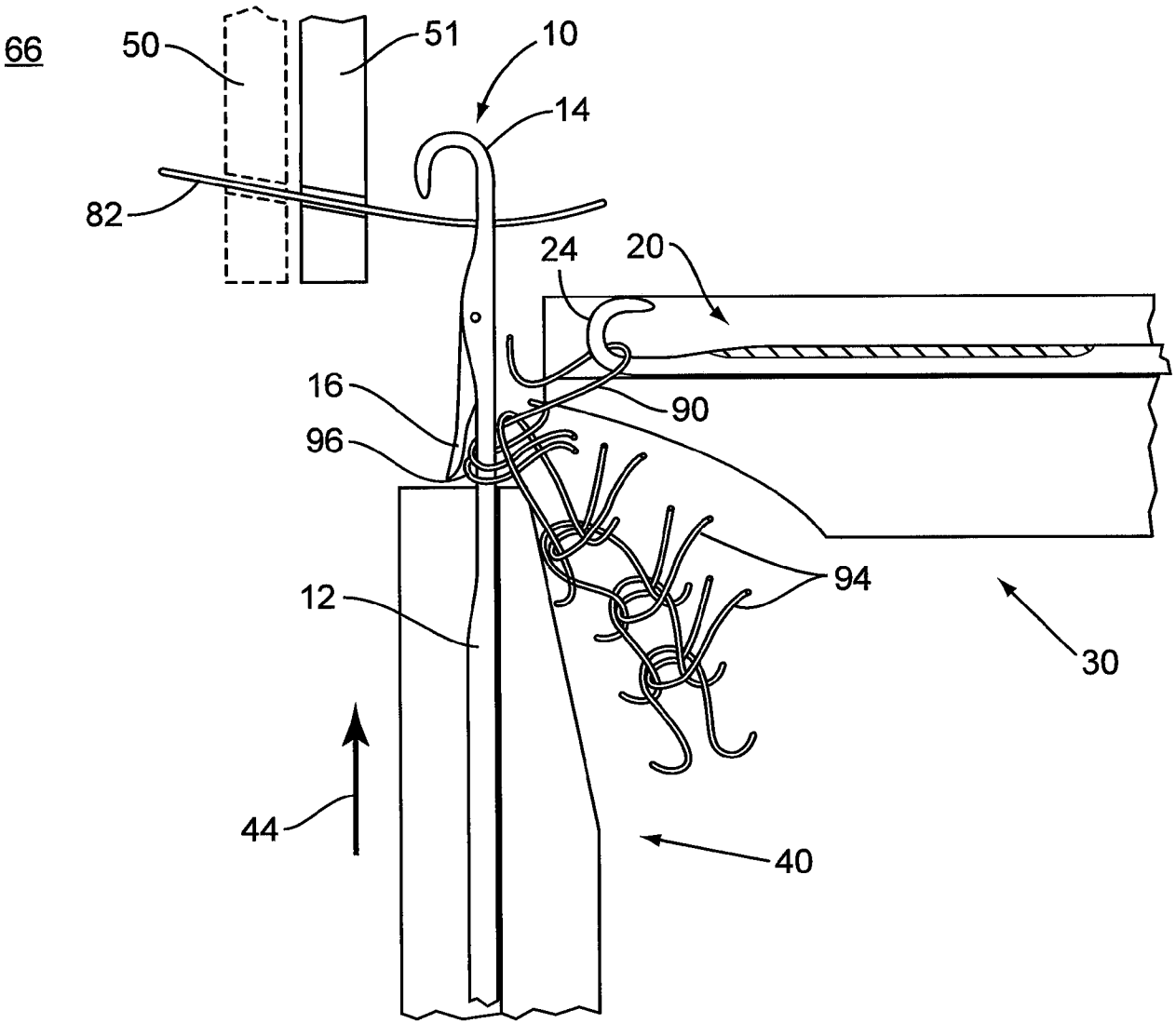

The held position 66 in FIG. 5C shows the cylinder needle 10 having the first and second yarns 80 and 82 (shown in FIG. 5B) forming a plated pair of loops 96 around stem 12. Plated, or plating, as used herein, refers to two or more yarns simultaneously present within the stem or hook of a needle. The cutting needle 20 is illustrated in FIG. 5C retracted within the dial 30 and holding the first yarn 80 within its hook 24. As the cutting needle 20 approaches the knock over position 68 shown in FIG. 5D, a cut loop 94 (formed at the tuck position 62) is released. During the release of the cut loop 94, the cylinder needle 10 moves in a first direction 44 to receive the second yarn 82 from the yarn feeder 51.

Figure 5D:
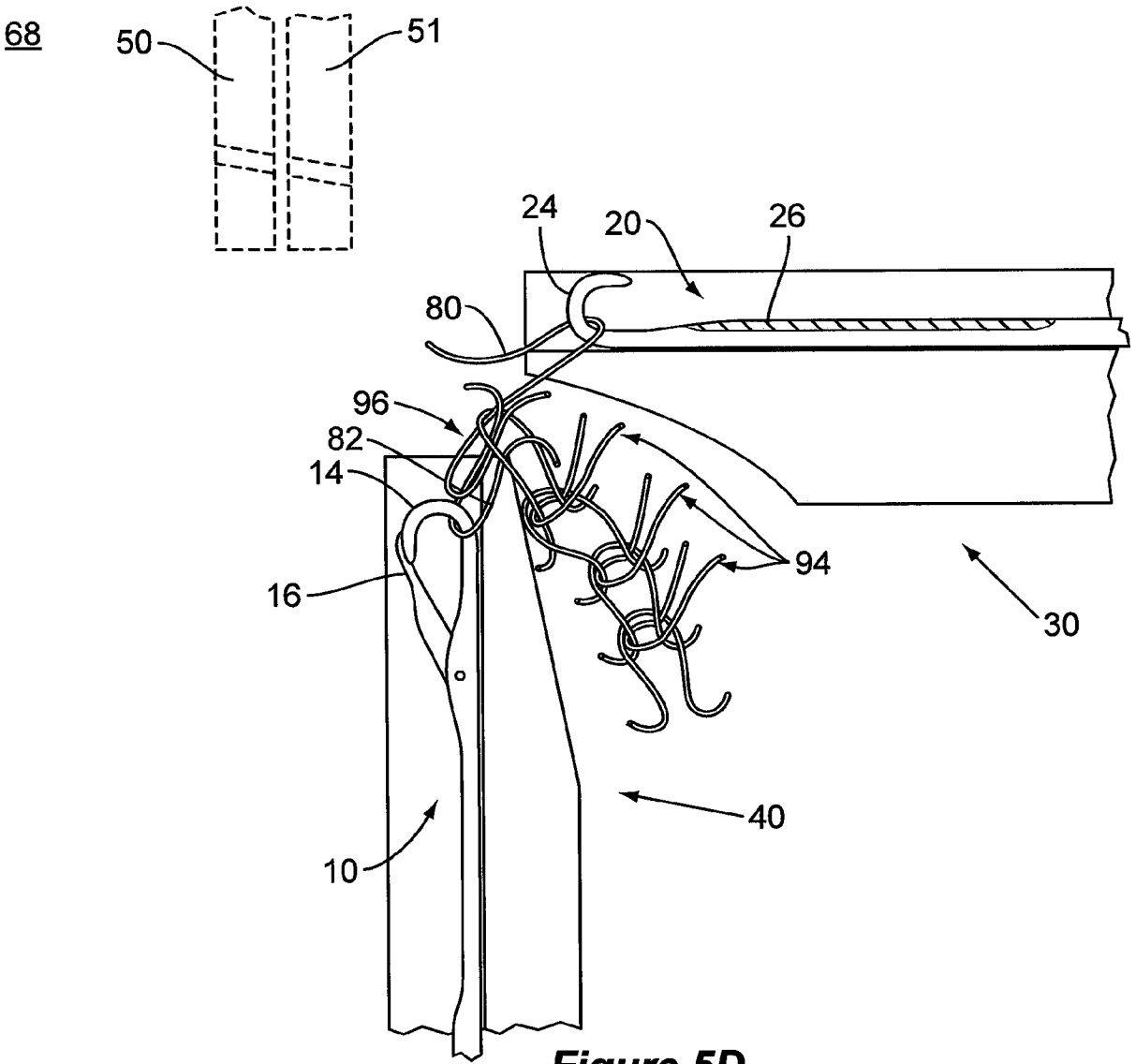

FIG. 5D illustrates the knock over position 68 and the cylinder needle 10 retracted within the cylinder 30. At this stage of the knitting cycle, the cylinder needle 10 has traveled over and around the second up-throw cam 146 (shown in FIG. 6) pulling the second yarn 82 through the plated loops 96. At the knock over position 68, the cylinder needle 10 (or the needle butt 18 not shown) is within cam path 135 between the second stitch cam 148 and the third up-throw cam 149 as shown in FIG. 6. The cutting needle 20 remains stationary for a period of time at the held 66 and knock over 68 positions while holding the first yarn 80 within its hook 24. The time the cutting needle 20 remains stationary in the dial 30 depends on the profile of the dial cam path 135 at the held stitch cams 136 and 137, as shown in FIG. 6.

Upon forming loop 90, the knitting cycle starts over at the tuck height position 62 described above. The cutting needle 20 crosses cylinder needle 10, severing the first yarn 80 with the cutting surface 26 to from the cut loops 94. Thus, a cut pile is formed during the knitting cycle.

Figure 7A:
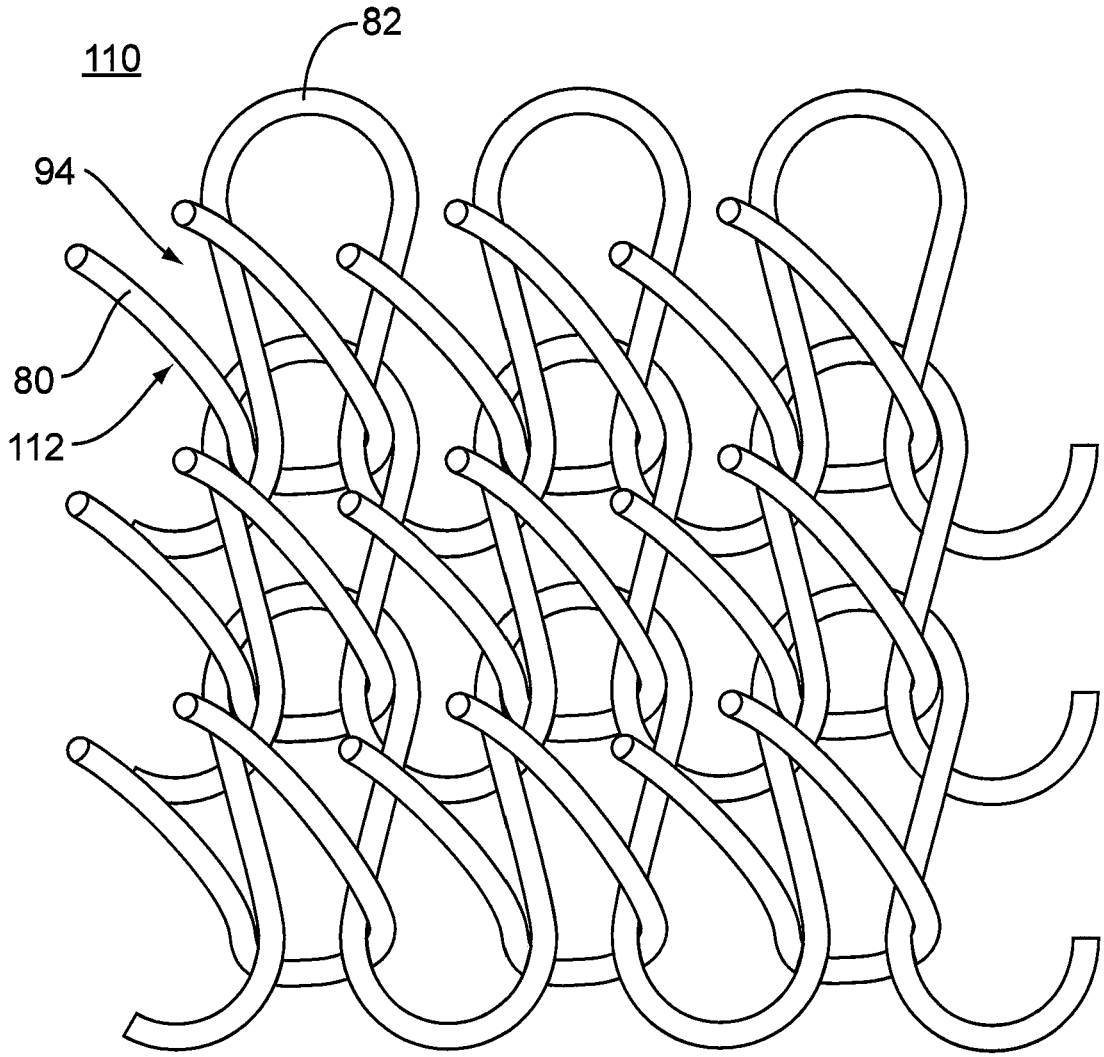
FIGS. 7A and 7B are top perspective and side perspective views of a cut pile fabric.
Figure 7B:
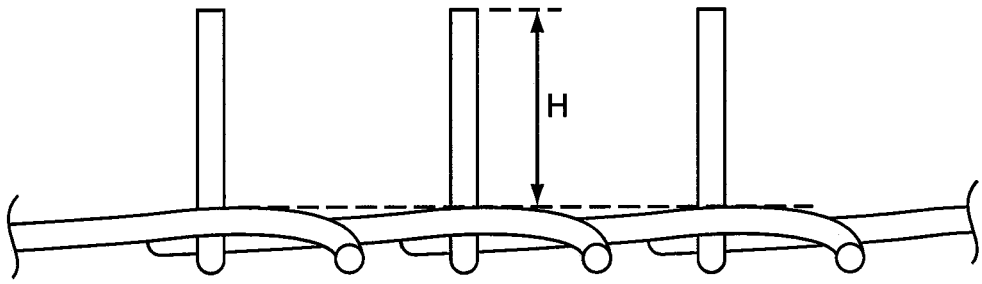

An illustrative embodiment of a cut pile fabric is shown in FIGS. 7A and 7B. The cut loops 94 extend upwardly from the surface of the fabric as shown and have a pile height, H. Pile height refers to the distance, H, from an upper surface of a fabric to the end of the pile as shown in FIG. 7B. The pile height, H, may be adjusted by modifying the cylinder cam path 135 (see FIG. 6), changing the distance between the cylinder 40 and dial 30, or by regulating the tension of the yarns as they are fed to the needles during knitting.

The location of the cylinder needle 10 at the knock over position 68 during the knitting cycle may impact the length of the cut loops 94, and thus the pile height, H, of a cut pile fabric 110. For example, the cam path 135 may be designed so that cylinder needle 10 descends further within cylinder slot 43 at the knock over position 68. The lower the cylinder needle 10 within the cylinder 40, the longer the cut loop 94 and the longer the pile height, H.

Figure 8:
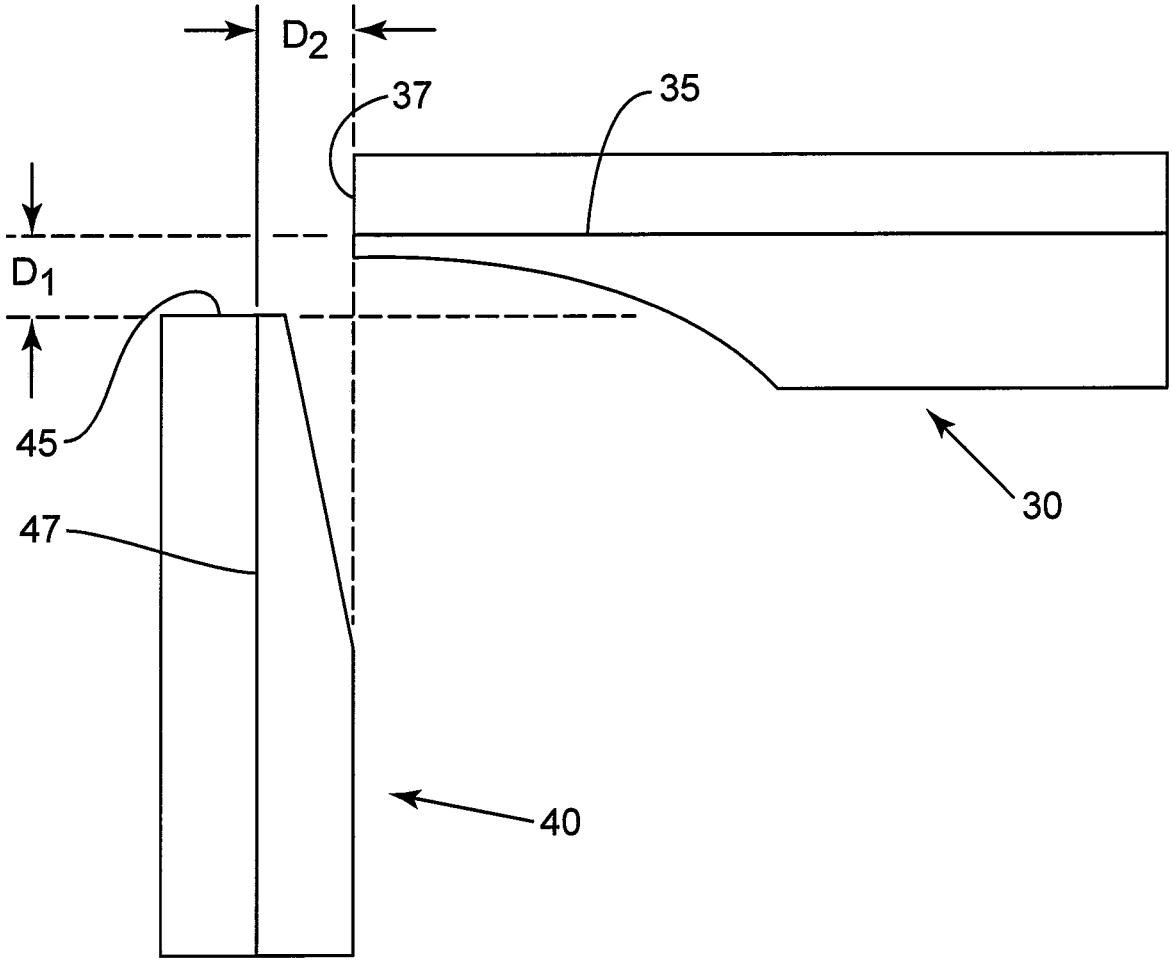
FIG. 8 is an additional side view of a segment of a knitting machine used to form a cut pile fabric

The distances between the cylinder 40 and dial 30 may also increase or decrease pile height, H. As shown in FIG. 8, a first distance, $D_1$, may be the distance between a line substantially parallel to the dial surface 35 and a line substantially parallel to the upper surface 45 of the cylinder 40. A second distance, $D_2$, may be the distance between a line substantially parallel to the cylinder surface 47 and line substantially parallel with side surface 37 of the dial 30. The length of cut loops 92 may be adjusted by increasing or decreasing $D_1$ and $D_2$ independently, or by adjusting both $D_1$ and $D_2$. As $D_1$ or $D_2$ increase, the length of the cut loops 94, and thus the pile height, H, increase.

A positive feed system may be used to regulate fluctuation in yarn tension as they are fed into the knitting machine 100. Fluctuations in yarn tension as the needles receive and pull the yarns during the knitting cycle may create an irregular pile. A positive feed system minimizes the fluctuations in yarn tension. For example, a positive feed system may increase the yarn tension resulting in loops contracting when the cut pile fabric is removed from the machine. The contracted loops could decrease the pile height. A positive feed system also may be used to maintain a steady yarn tension during knitting.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A method of forming a cut pile fabric, the method comprising:

providing a plurality of cylinder needles on a knitting machine cylinder and a plurality of cutting needles on a knitting machine dial, each of the plurality of cutting needles having a cutting surface;

feeding a first yarn to the plurality of cylinder and cutting needles during a knitting cycle to form first loops on the plurality of cylinder needles and second loops on the plurality of cutting needles;

feeding a second yarn to the plurality of cylinder needles;

forming plated loops on the plurality of cylinder needles with the first and second yarns during a single stage of the knitting cycle; and forming a pile on the knit fabric by cutting the first loops on the plurality of cutting needles with the cutting surfaces to form cut loop ends, the plated loops holding the cut loop ends in the knit fabric to form the pile.

2. The method of claim 1, wherein the step of forming the plated loops further comprises:

holding the plurality of cutting needles stationary during the knitting cycle as the plurality of cylinder needles receives the second yarn to form the plated loops.

3. The method of claim 1, wherein the cotton count of the first yarn is greater than the cotton count of the second yarn.

4. The method of claim 1, wherein the first yarn is selected from the group comprising a ring-spun yarn, an open-end yarn, an air-jet spun yarn, and a continuous filament yarn.

5. The method of claim 1, wherein the second yarn is selected from the group comprising a ring-spun yarn, an open-end yarn, an air-jet spun yarn, and a continuous filament yarn.

6. A method of forming a cut pile knit fabric, the method comprising:

providing a plurality of cylinder needles on a knitting machine cylinder and a plurality of cutting needles on a knitting machine dial, each of the plurality of cutting needles having a cutting surface;

feeding a first yarn to the plurality of cylinder and cutting needles during a knitting cycle to form first loops on the plurality of cylinder needles and second loops on the plurality of cutting needles;

feeding a second yarn to the plurality of cylinder needles;

forming plated loops on the plurality of cylinder needles with the first and second yarns during a single stage of the knitting cycle;

holding the plurality of cutting needles stationary during the knitting cycle as the plurality of cylinder needles receives the second yarn to form the plated loops; and forming a pile on the knit fabric by cutting the first loops on the plurality of cutting needles with the cutting surfaces to form cut loop ends, the plated loops holding the cut loop ends in the knit fabric to form the pile.

7. The method of claim 6, wherein the cotton count of the first yarn is greater than the cotton count of the second yarn.

8. The method of claim 6, wherein the first yarn is selected from the group comprising a ring-spun yarn, an open-end yarn, an air-jet spun yarn, and a continuous filament yarn.

9. The method of claim 6, wherein the second yarn is selected from the group comprising a ring-spun yarn, an open-end yarn, an air-jet spun yarn, and a continuous filament yarn.

10. The method of claim 6, wherein the knit fabric forms a portion of a garment selected from the group comprising sweatshirts, sweatpants, underwear and outwear.

11. A method of forming a knit fabric, the method comprising:

providing a plurality of cylinder needles on a knitting machine and a plurality of cutting needles on a knitting machine capable of translating across the plurality of cylinder needles, each of the plurality of cutting needles having a cutting surface;

feeding a first yarn to the plurality of cylinder and cutting needles during a knitting cycle to form first loops on the plurality of cylinder needles and second loops on the plurality of cutting needles;

feeding a second yarn to the plurality of cylinder needles;

forming plated loops on the plurality of cylinder needles with the first and second yarns during a single stage of the knitting cycle;

holding the plurality of cutting needles stationary during the knitting cycle so that the plurality of cylinder needles receives the second yarn to form the plated loops; and forming a pile on the knit fabric by cutting the first loops on the plurality of cutting needles with the cutting surfaces to form cut loop ends, the plated loops holding the cut loop ends in place to form the pile.

12. The method of claim 11, wherein the knitting machine is a flat v-bed machine.

13. The method of claim 11, wherein the cotton count of the first yarn is greater than the cotton count of the second yarn.

14. The method of claim 11, wherein the first yarn is selected from the group comprising a ring-spun yarn, an open-end yarn, an air-jet spun yarn, and a continuous filament yarn.

15. The method of claim 11, wherein the second yarn is selected from the group comprising a ring-spun yarn, an open-end yarn, an air-jet spun yarn, and a continuous filament yarn.

* * * * *